US005923122A

United States Patent [19]

Frank et al.

[11] Patent Number: 5,923,122

[45] Date of Patent: Jul. 13, 1999

[54] ELECTRODELESS BULB WITH MEANS FOR RECEIVING AN EXTERNAL STARTING ELECTRODE

[75] Inventors: Jerome D. Frank, Bethesda; Gregory Walter, Frederick; Pedro Lezcano, Gaithersburg; Miodrag Cekic, Bethesda, all of Md.

[73] Assignee: Fusion UV Systems, Inc., Gaithersburg, Md.

[21] Appl. No.: 09/056,646

[22] Filed: Apr. 8, 1998

[51] Int. Cl.[6] ..... H01J 65/04

[52] U.S. Cl. ..... 313/607; 313/634; 313/493; 313/30; 313/32; 313/248; 313/344

[58] Field of Search ..... 313/634, 607, 313/234, 493, 30, 32, 35; 315/39, 248, 344

[56] References Cited

U.S. PATENT DOCUMENTS 5,493,184 2/1996 Wood et al. ..... 315/344
5,767,626 6/1998 Kamarehi et al. ..... 315/39
5,838,108 11/1998 Frank et al. ..... 315/39

*Primary Examiner*—Nimeshkumar D. Patel
*Attorney, Agent, or Firm*—Shlesinger, Arkwright & Garvey LLP

[57] ABSTRACT

An electrodeless lamp comprises an envelope containing a fill and a substance for facilitating the starting of the lamp. An outer tube is secured to an outside portion of the envelope in proximity to the given region and an inner tube is disposed within the outer tube such that a fluid passageway is defined between an inner surface of the outer tube and an outer surface of the inner tube. A hollow retractable electrode is provided within the inner tube, the electrode having a first position in which its tip portion is in proximity to the given region of the envelope when the lamp is being started and a second position in which the tip portion is away from the envelope after the lamp is started. A source of cooling fluid is operably connected to the hollow electrode such that the cooling fluid is forced through the hollow electrode and exhausted through the fluid passageway. A power source is operably connected to the electrode in the first position for applying an electric field to the substance to cause a discharge of the fill. An excitation power source is coupled to the fill to sustain the discharge.

23 Claims, 3 Drawing Sheets

ELECTRODELESS BULB WITH MEANS FOR RECEIVING AN EXTERNAL STARTING ELECTRODE

FIELD OF THE INVENTION

The present invention relates generally to electrodeless lamps that contain high pressure and/or electronegative fills and in particular to a bulb used in an electrodeless lamp including a means for receiving an external starting electrode and for facilitating cooling of a part of the bulb wall to re-accumulate the electronegative substance within the bulb that is used for starting the lamp.

BACKGROUND OF THE INVENTION

In a prior copending patent application, entitled "Method and Apparatus for Starting Difficult to Start Electrodeless Lamps," Ser. No. 08/696,706, a hollow electrode, disposed within a tube called a sidearm that is attached to the bulb envelope, is used to start an electrodeless lamp. To start the lamp, one end of the electrode is moved to contact the envelope at the bulkhead region where a field or secondary electron emission substance is disposed within the envelope. Compressed air is directed through the hollow electrode and exhausted back out through the space formed between the inner wall surface of the sidearm and the outside surface of the electrode. Pulsed R.F. energy is applied to the electrode for about 300 ms, after which the electrode is withdrawn and a photocell is monitored to determine if ignition has occurred. If there has been ignition, the power supply to the lamp is allowed to schedule to the commanded level. If ignition did not occur, the power supply is shut down and ignition is again attempted. Differential cooling of the bulkhead region relative to the rest of the lamp facilitates re-accumulation of the field emission substance at the bulkhead region for use in the next starting event.

It was found that not enough cooling was occurring at the bulkhead region to prevent the formation of corona and to permit the re-accumulation of the field or secondary electron emission substance. It was found that after the electrode is withdrawn away from the envelope, air within the sidearm adjacent the envelope would stagnate, creating a layer of dead air space that prevents sufficient cooling of the bulkhead region. The result was that the field emission substance would not re-accumulate at the bulkhead, causing re-starting of the lamp to become undependable.

The present invention provides a solution to the above problem.

OBJECTS AND SUMMARY OF THE INVENTION

It is therefore an object of the present invention to provide an electrodeless lamp that would re-start dependably each time.

It is another object of the present invention to provide an electrodeless lamp that promotes sufficient cooling at the bulkhead region so as to cause the field emission substance to re-accumulate at the bulkhead region for the next starting event.

It is still another object of the present invention to provide an electrodeless lamp that minimizes the formation of ionized gas in the air in the vicinity of the tip portion of the starting electrode, thereby minimizing the formation of corona and micro-arcing.

It is another object of the present invention to provide an electrodeless lamp with improved dielectric system in the sidearm.

In summary, the present invention provides an electrodeless lamp, comprising an envelope containing a fill and a substance disposed on a given region within the envelope for facilitating starting of lamp; an outer tube secured to an outside portion of the envelope in proximity to the given region and an inner tube disposed within the outer tube such that a fluid passageway is defined between an inner surface of the outer tube and an outer surface of the inner tube; a hollow retractable electrode within the inner tube, the electrode having a first position in which a tip portion of the electrode is in proximity to the given region of the envelope when the lamp is being started and a second position in which the tip portion is away from the envelope after the lamp is started; a source of cooling fluid operably connected to the hollow electrode such that the cooling fluid is forced through the hollow electrode and exhausted through the fluid passageway; a power source operably connected to the electrode in the first position for applying an electric field to the substance to cause a discharge of the fill; and excitation power source coupled to the fill to sustain the discharge.

These and other objects of the present invention will become apparent from the following detailed description.

BRIEF DESCRIPTIONS OF THE DRAWINGS

DETAILED DESCRIPTION OF THE INVENTION

Figure 1:
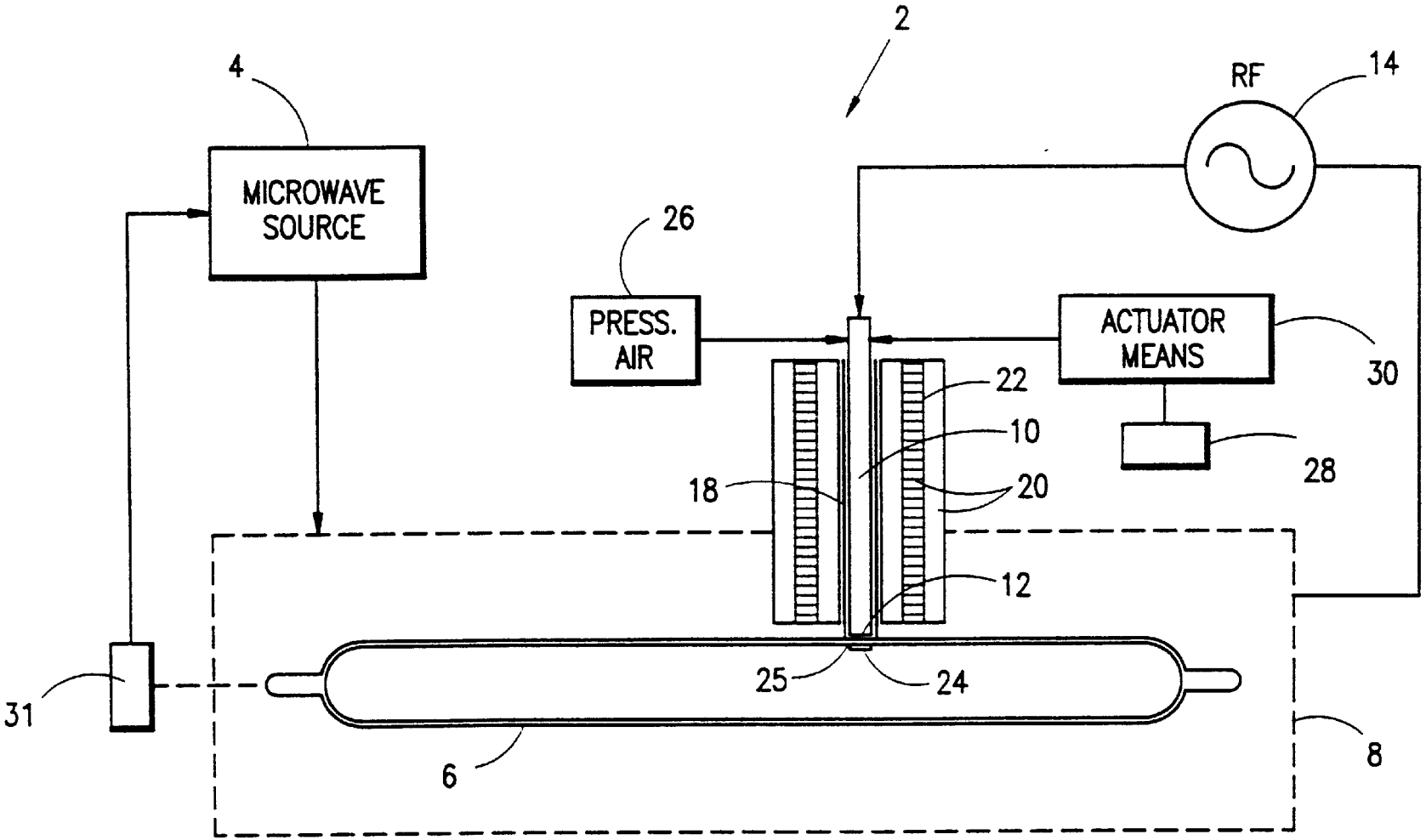
FIG. 1 is schematic representation of an electrodeless lamp made in accordance with the present invention.
Figure 2:
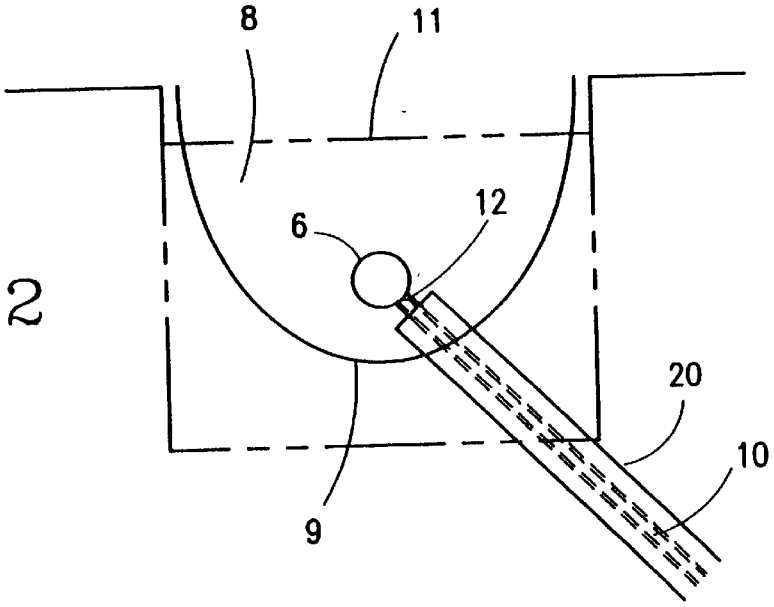
FIG. 2 is a schematic cross-sectional view of the lamp of FIG. 1, with the starting electrode shown in the starting position in contact with the envelope wall.
Figure 3:
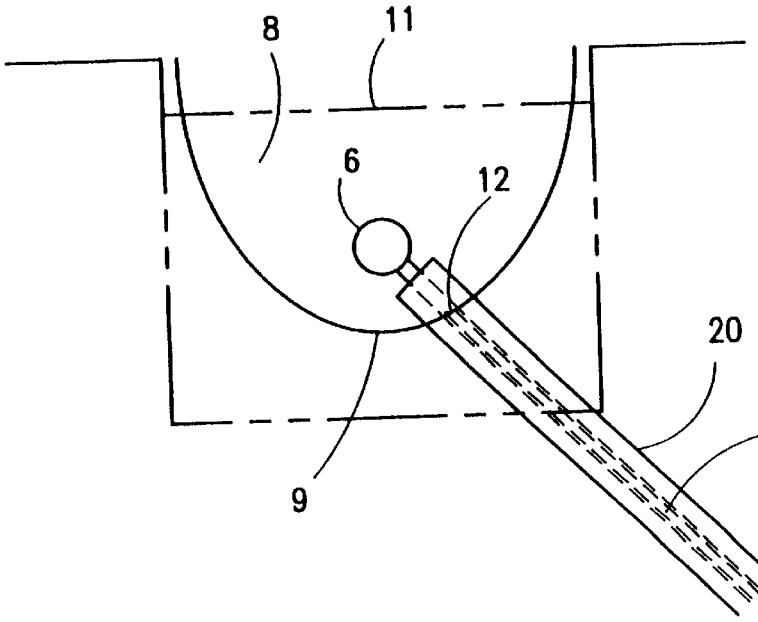
FIG. 3 is a schematic cross-sectional view of the lamp of FIG. 1, showing the starting electrode in the retracted position away from the envelope wall and outside the microwave cavity.

An electrodeless lamp 2 made in accordance with the present invention is disclosed in FIG. 1. The lamp 2 is powered by microwave energy source 4. Envelope 6 contains a discharge forming fill, and is located in microwave enclosure 8, which is schematically shown in the figure. In the preferred embodiment, enclosure 8 is a microwave chamber or cavity comprised of a reflector 9, and a mesh 11 which is transparent to the radiation emitted by the fill, as best shown in FIGS. 2 and 3.

In addition to the microwave energy, it is conventional to apply auxiliary power to start the lamp. For example, a small ultraviolet lamp radiating the fill may be used for this purpose. In lamps which are harder to start, it is known to use an auxiliary electrode which is powered by R.F. energy. However, even with such auxiliary sources, there is a class of lamps which resist starting. Two examples in this class are electrodeless lamps with relatively high pressure fills, and/or those fills which contain electronegative species.

A probe or electrode 10, preferably made of molybdenum tube, is provided which extends through an opening in the microwave cavity 8 so that its tip 12 is in proximity of the envelope 6. In the preferred embodiment, the tip 12 actually contacts the envelope wall so as to prevent arcing between the tip and the envelope wall, which could occur if an air gap were present.

A series of R.F. pulses from the R.F. oscillator 14 is provided to the electrode 10 at starting. The electrode 10 is disposed within an insulating, heavy wall tube 18, called a sidearm, preferably made of quartz, which in turn is disposed within a toroidal insulating jacket 20 containing an insulation gas 22, such as sulfur hexafluoride, as best shown in FIGS. 1, 2 and 3.

A field or secondary electron emission source 24, such as cesium chloride, is disposed in the interior of the envelope 6 at a region 25 called the bulkhead under the probe tip 12. The substance 24 is initially provided at this region 25 by putting the substance in the fill, heating the envelope enough to cause the substance to decompose or sublimate, then by preferentially cooling the bulkhead region 25 to cause the material to condense in the bulkhead region. This may be accomplished before the bulb is placed in the lamp. Other examples of field or secondary emission sources are disclosed in copending application Ser. No. 08/696,706.

The electric field applied by the electrode 10 is of sufficient magnitude to cause the field emission of electrons from the substance 24. The resulting electrons in combination with the electric field from the electrode 10 and the microwave field cause the fill to change to plasma, which is then sustained by the microwave power coupled to the bulb. The R.F. pulse is applied in synchronism with the peak of the microwave field.

During starting and operation of the lamp, a source of pressurized air 26 or other suitable cooling fluid is supplied to the tip 12 of the probe to minimize the corona effect, as will be discussed in more detail below.

To start the lamp, the electrode 10 is extended into the microwave cavity until its tip 12 contacts the envelope wall, as best shown in FIG. 2. Pulsed R.F. power is then supplied to the electrode 10 for about 300 ms, after which the electrode is retracted away from the lamp envelope 6 and out of the interior of the cavity 8, as best shown in FIG. 3, to advantageously prevent radiation of the microwave energy to outside of the cavity, since the electrode acts as an antenna, and to prevent puncture and interference with the microwave field in the cavity. A timer 28 set at approximately 300 ms actuates an actuator 30, such as a piston-cylinder arrangement, at the expiration of the preset period, to retract the electrode away from the envelope and outside of the microwave cavity. A light sensing device 31 senses the light output of the lamp after the 300 ms period so as to cutoff the microwave source in case the lamp fails during start-up or operation. The arrangement of the light sensing device 31 is disclosed in co-pending application Ser. No. 08/840,709, filed on Apr. 25, 1997, which is hereby incorporated by reference.

After the lamp has been used for its intended purpose, it is turned off by removing the microwave power. Since the high temperature generated by the bulb would evaporate the substance 24, it is essential to ensure that the field or secondary electron emission source 24 is at the bulkhead region 25 after the lamp is turned off, so that when the lamp is next started it will be available at this region where the starting electric field is applied. This may be accomplished either by arranging for the bulkhead to be the coolest region of the envelope, thus promoting condensation of the field emitting source 24 at this location, or by gravity, i.e., by arranging for the bulkhead to be the lowest region in the envelope.

An electrodeless lamp as described above is disclosed in co-pending application Ser. No. 08/696,706, filed Aug. 14, 1996, which is hereby incorporated by reference.

Figure 5:
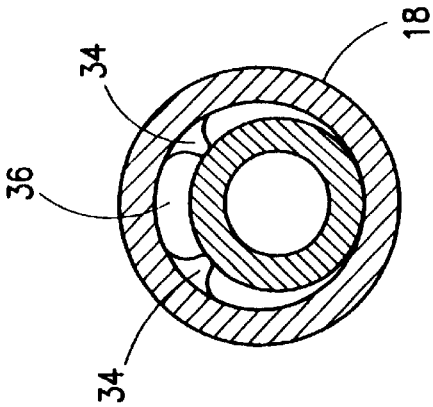
FIG. 5 is cross-sectional of view taken along line 5—5 in FIG. 2.
Figure 4:
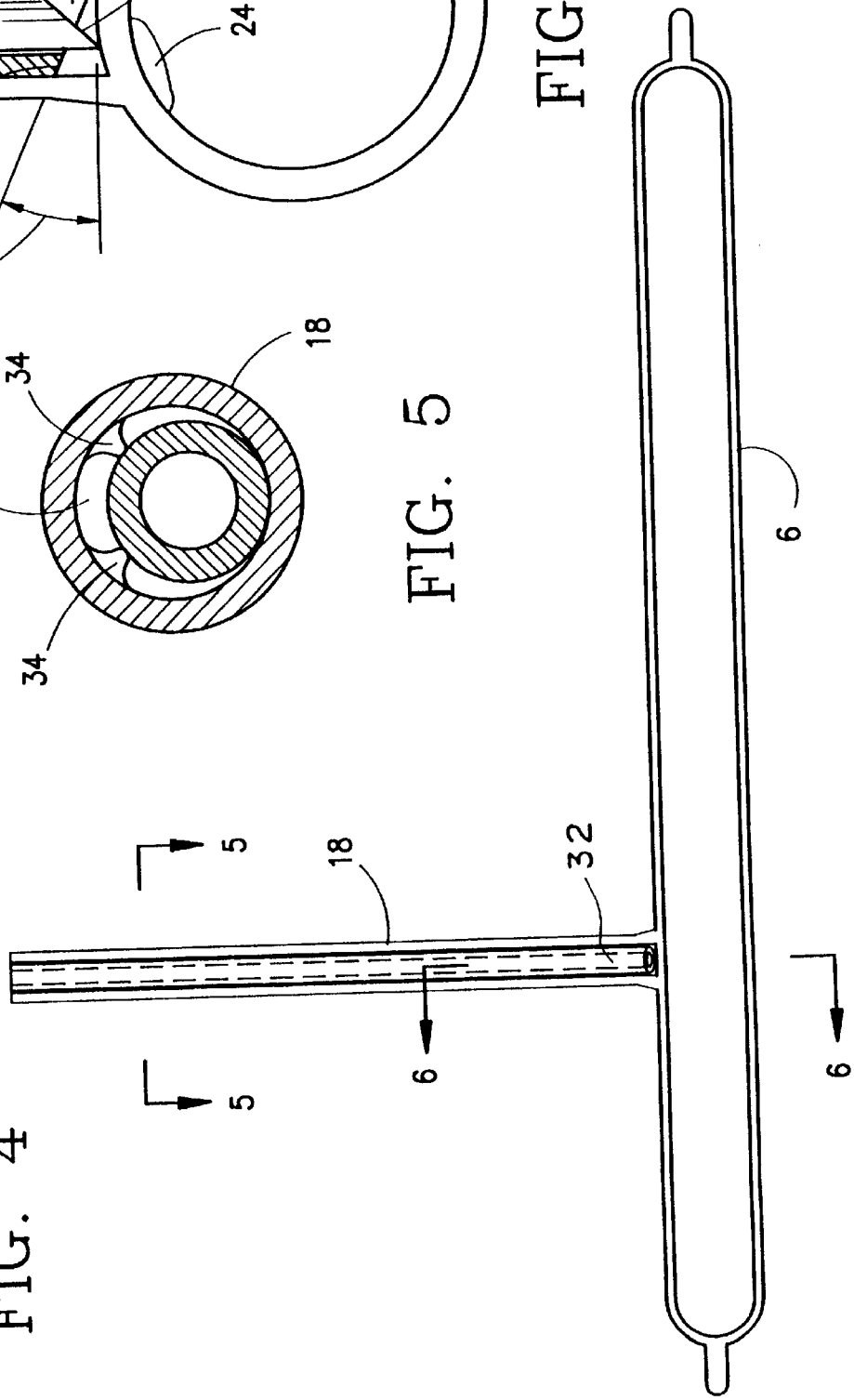
FIG. 4 is a longitudinal view of the bulb used in the lamp of FIG. 1.

The tube 18 is preferably transversely secured to the envelope 6, as best shown in FIG. 4. An insulating inner tube 32, preferably made of quartz, is disposed within the outer tube 18 preferably in an eccentric fashion, as best shown in FIG. 5. A plurality of projections 34 secure the inner tube 32 against the inner wall surface of the tube 18. A fluid passageway 36 is thus formed between the inner wall surface of the tube 18 and the outer wall surface of the tube 32, as best shown in FIGS. 3 and 4, to advantageously carry exhaust cooling fluid that is fed into the sidearm during operation without mixing with the incoming cooling fluid. The inner tube 32 advantageously increases the dielectric performance of the sidearm, providing increased insulation level around the electrode 10 which is subject to about 80 Kv during starting. The passageway 32 provides a separate return path for the compressed air at the bottom of the tube 18, thereby eliminating any dead air space that prevents effective cooling of the bulkhead region.

Figure 6:
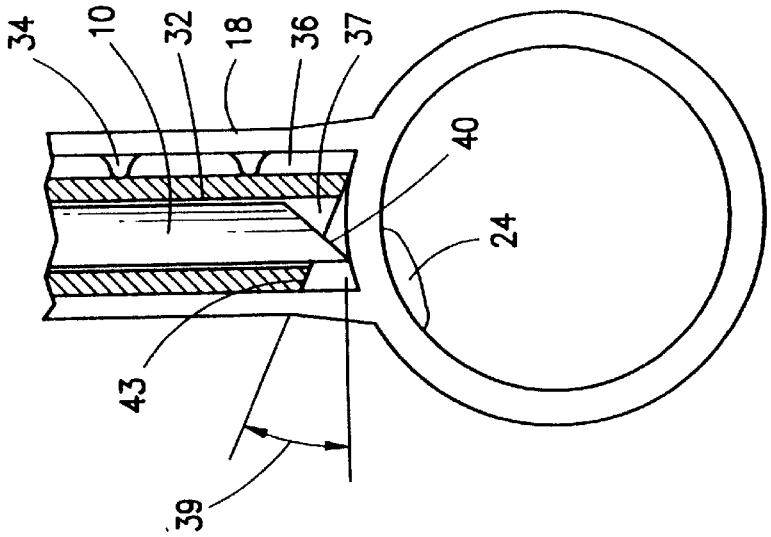
FIG. 6 is an enlarged cross-sectional view taken along line 6—6 in FIG. 4, with the electrode shown disposed within the inner tube.

One end 37 of the inner tube 32 is advantageously cut at an angle 39, approximately 15°–45°, preferably 20°, as best shown in FIG. 6. The outer edge of the end 37 has a portion 43, which is in contact with the inner surface of the outer tube 18 and disposed above the envelope. The beveled arrangement advantageously promotes turbulence at the bulkhead region as the pressurized air is forced down through the hollow electrode 10, and is exhausted through the passageway 36. The end 37 of the inner tube 32 advantageously acts as a nozzle that promotes adiabatic and isotropic expansion to provide a cooling effect in the bulkhead region from the expansion of the air. Additionally, there is increased turbulence for effective heat transfer so that the Reynolds number is in excess of 2,100. Other configurations for the end 37 to effect effective cooling and heat transfer are possible.

Compressed air or other suitable cooling fluid is continuously directed through the hollow electrode 10 and exhausted through the passageway 36 at high pressure and high velocity to make the bulkhead region 25 relatively colder in relation to the rest of the envelope 6, thereby promoting the re-accumulation by condensation of the field or secondary electron emission source 24 at the bulkhead region for the next starting event of the lamp. The temperature at which the lamp operates is approximately at the point where the substance 24 starts to sublimate so that the bulkhead region which is kept at a lower temperature relative to the rest of the envelope wall will cause the substance 24 to condense on that area even during operation of the lamp so that the lamp can be restarted almost immediately after being turned off.

The compressed air or cooling fluid directed to the bulkhead region serves to pressurize the air space within the tube 18 adjacent bulkhead region 25 and allows the lamp to operate at the lower portion of the Paschen curve, advantageously suppressing micro-arcing during starting when the bulkhead region is subjected to extremely high electric field. The electric field within the cavity 8 is in excess of 50 Mv/m, which is in excess of the breakdown voltage of air.

In the prior application, where the inner tube 32 is not used within the sidearm tube 18, it was found that only a small amount of heat exchange took place at the tip 12 and the bulkhead region 25. It was found that a stagnation zone becomes established at the bottom of the tube 18 after the electrode 10 is withdrawn from contact with the envelope wall. The result is that the field or secondary electron emission substance 24 does not re-accumulate at the bulkhead region.

Figure 7:
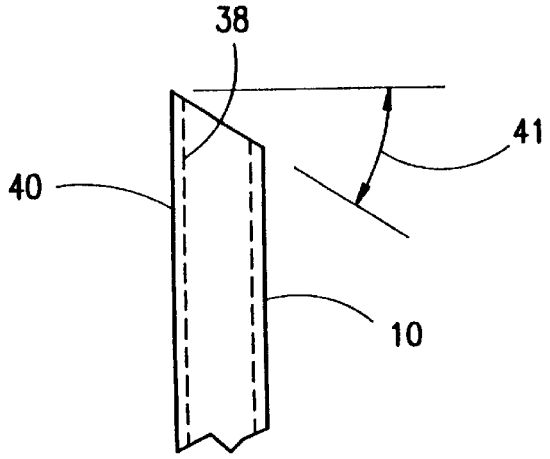
FIG. 7 shows a detailed view of the tip of the electrode used in the present invention.

The tip 12 of the hollow electrode 10 has an opening 38 and is cut an angle 41, preferably 45°, to allow the compressed air directed through the electrode to escape when the tip is in contact the bulb envelope during lamp starting, as best shown in FIG. 7. Corona-induced electrode damage is thereby advantageously minimized by the rapid removal of ionization products from the tip area by the pressurized air or cooling fluid flowing out of the electrode tip 12. This also allows the electrode to be made of a lesser refractory-type material, such as stainless steel. The compressed air or cooling fluid directed down through the electrode at the bulkhead region further creates a high pressure zone at the tip 12 of the electrode, advantageously preventing micro-arcing between the electrode and the envelope wall.

The tip 12 includes a point portion 40 that advantageously increases the power density during starting that is applied to the field or secondary electron emission source 24 disposed at the bulkhead region of the envelope wall. The point 40 is disposed directly opposite the substance 24 for effective application of the starting power, as best shown in FIG. 6.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. An electrodeless lamp, comprising:

a) an envelope containing a fill and a substance disposed on a given region of said envelope to facilitate starting of the lamp;

b) an outer tube secured to an outside portion of said envelope in proximity to said given region;

c) an inner tube disposed within said outer tube such that a fluid passageway is defined between an inner surface of said outer tube and an outer surface of said inner tube;

d) a retractable hollow electrode within said inner tube, said electrode having a first position in which an end portion of said electrode is in contact with said envelope and in proximity of said given region when the lamp is being started and a second position in which said end portion is disposed away from said envelope after the lamp is started;

e) a source of cooling fluid operably connected to said inner tube such that said cooling fluid is forced through said hollow electrode and exhausted through said fluid passageway thereby to cool said given region to facilitate condensation of said substance on said given region;

f) a power source operably connected to said electrode in said first position for applying an electric field to said substance to cause a discharge; and g) excitation power source coupled to said fill to sustain the discharge.

2. An electrodeless lamp as in claim 1, wherein:

a) said inner tube has a first end disposed near said envelope; and b) said first end is cut at an angle.

3. An electrodeless lamp as in claim 2, wherein:

a) said angle is approximately between 15°–45°.

4. An electrodeless lamp as in claim 2, wherein:

a) said angle is approximately 20°.

5. An electrodeless lamp as in claim 1, wherein:

a) said inner tube is disposed eccentrically within said outer tube.

6. An electrodeless lamp as in claim 5, wherein:

a) said inner tube has a longitudinal outside surface portion that engages a longitudinal inside surface of said outer tube.

7. An electrodeless lamp as in claim 2, wherein:

a) said first end of said inner tube includes an outer edge; and b) one portion of said outer edge is disposed against an inner surface of said outer tube at a distance above said envelope.

8. An electrodeless lamp as in claim 1, wherein:

a) said inner tube is secured inside said outer tube by a plurality of projections extending from the inside surface of said outer tube toward the outer surface of said inner tube.

9. A bulb for use in an electrodeless lamp, comprising:

a) an envelope containing a fill;

b) an outer tube secured to an outside portion of said envelope and an inner tube disposed within said outer tube such that a fluid passageway is defined between an inner surface of said outer tube and an outer surface of said inner tube;

c) said inner tube being adapted to receive a starting electrode retractable within said inner tube; and d) said passageway being adapted to exhaust cooling fluid directed through said inner tube.

10. A bulb as in claim 9, wherein:

a) said inner tube has a first end disposed near said envelope; and b) said first end is cut at an angle.

11. A bulb as in claim 10, wherein:

a) said angle is approximately 20°.

12. An electrodeless lamp as in claim 9, wherein:

a) said inner tube is disposed eccentrically within said outer tube.

13. A bulb as in claim 9, wherein:

a) said inner tube has a longitudinal outside surface portion that engages a longitudinal inside surface of said outer tube.

14. A bulb as in claim 10, wherein:

a) said first end includes an outer edge; and b) one portion of said outer edge is disposed against an inner surface of said outer tube at a distance above said envelope.

15. A bulb as in claim 9, wherein:

a) said inner tube is secured inside said outer tube by a plurality of projections extending from the inside surface of said outer tube toward the outer surface of said inner tube.

16. An electrodeless lamp, comprising:

a) an envelope containing a fill and a substance disposed on a given region of said envelope to facilitate starting of the lamp;

b) a first tube secured to an outside portion of said envelope in proximity to said given region;

c) a retractable electrode within said first tube, said electrode having a first position in which an end portion of said electrode is in contact with said envelope in proximity of said given region when the lamp is being started and a second position in which said end portion is disposed away from said envelope after the lamp is started;

d) said first tube including first and second fluid passageways;

e) a source of cooling fluid operably connected to said first tube such that said cooling fluid is forced through said first fluid passageway and exhausted through said second fluid passageway thereby to cool said given region;

f) a power source operably connected to said electrode in said first position for applying an electric field to said substance during starting of the lamp to generate a discharge; and g) excitation power source coupled to said fill to sustain the discharge.

17. An electrodeless lamp as in claim 16, wherein:

a) said electrode is hollow; and b) said source of cooling fluid is directed through said hollow electrode.

18. An electrodeless lamp as in claim 16, wherein:

a) said electrode includes a point; and b) said point is disposed adjacent said given region when said electrode is in said first position.

19. An electrodeless lamp as in claim 16, and further comprising:

a) a second tube disposed within said first tube;

b) said first fluid passageway is defined by said second tube; and c) said second passageway is defined between an inner surface of said first tube and an outer surface of said second tube.

20. An electrodeless lamp as in claim 19, wherein:

a) said second tube has a first end disposed near said envelope; and b) said first end is cut at an angle.

21. An electrodeless lamp as in claim 20, wherein:

a) said angle is approximately between 15°–45°.

22. An electrodeless lamp as in claim 20, wherein:

a) said angle is approximately 20°.

23. A method for starting an electrodeless lamp, comprising the steps of:

a) providing a bulb comprised of an envelope and a discharge forming fill in said envelope, the bulb including a tube secured to the envelope adjacent a given region within the envelope;

b) providing a field emission source on an interior surface of said envelope at the given region;

c) applying an electric field at the given region to cause field emission from said field emission source to cause a discharge;

d) coupling a power source to the fill to sustain the discharge;

e) directing cooling fluid into the tube toward the given region; and f) causing turbulence at the bottom of the tube adjacent the given region thereby to cool the region to facilitate condensation of the field emission source onto the given region such that the emission source will be available for the next starting of the lamp.

* * * * *